US007918384B2

(12) United States Patent
Gomes et al.

(10) Patent No.: US 7,918,384 B2
(45) Date of Patent: Apr. 5, 2011

(54) CARTON WITH DISPENSER

(75) Inventors: Jean-Manuel Gomes, Marietta, GA (US); Charles F. Ho Fung, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 859 days.

(21) Appl. No.: 11/767,148

(22) Filed: Jun. 22, 2007

(65) Prior Publication Data

US 2007/0295791 A1 Dec. 27, 2007

Related U.S. Application Data

(60) Provisional application No. 60/816,088, filed on Jun. 23, 2006.

(51) Int. Cl.
*B65D 17/28* (2006.01)

(52) U.S. Cl. ..... 229/240; 229/122; 229/242

(58) Field of Classification Search ..... 229/122, 229/122.1, 235, 240, 242; 206/427; 221/302–305
See application file for complete search history.

(56) References Cited

U.S. PATENT DOCUMENTS 1,925,102 A * 9/1933 Levkoff
2,005,924 A 6/1935 Wilsom
2,067,749 A 1/1937 Zimmerman et al.
2,115,673 A 4/1938 Stompe
2,299,027 A 10/1942 Novak
2,669,351 A 2/1954 Carson et al.
2,754,047 A 7/1956 Schmidt et al.
3,078,032 A 2/1963 Robinson et al.
3,128,010 A 4/1964 Forrer
3,133,634 A 5/1964 Bozdar
3,178,242 A 4/1965 Ellis et al.
3,228,582 A * 1/1966 Osberg
3,263,861 A 8/1966 Carr
3,265,283 A * 8/1966 Farquhar ..... 229/122.1
3,300,115 A 1/1967 Schauer
3,332,594 A 7/1967 De Capua
3,346,167 A 10/1967 Schmidt
3,356,279 A * 12/1967 Root
3,517,858 A 6/1970 Farquhar
3,533,549 A 10/1970 Gilchrist
3,540,581 A * 11/1970 Koolnis
4,155,449 A 5/1979 Bryne
4,214,660 A 7/1980 Hunt, Jr.
4,222,485 A 9/1980 Focke
4,256,226 A 3/1981 Stone
4,318,474 A 3/1982 Hasegawa
4,364,509 A 12/1982 Holley, Jr. et al.
4,375,258 A 3/1983 Crayne et al.
4,376,509 A 3/1983 Schaffer
4,378,877 A * 4/1983 Botterman et al.
4,396,143 A * 8/1983 Killy
4,417,655 A 11/1983 Forbes, Jr.
4,417,661 A 11/1983 Roccaforte (Continued)

FOREIGN PATENT DOCUMENTS

CA 873185 A1 6/1971

(Continued)

*Primary Examiner* — Gary E Elkins
(74) *Attorney, Agent, or Firm* — Womble Carlyle Sandridge & Rice, PLLC

(57) ABSTRACT

A carton having a dispenser with a removable dispenser panel. The dispenser panel is configured to be easily removed and to allow access to containers in the carton.

30 Claims, 4 Drawing Sheets

U.S. PATENT DOCUMENTS

| | | | | |
|---|---|---|---|---|
| 4,577,762 | A | 3/1986 | Kuchenbecker | |
| 4,605,128 | A * | 8/1986 | Rieke | |
| 4,658,984 | A | 4/1987 | Brunner | |
| 4,793,494 | A * | 12/1988 | Gordon, Jr. | 229/240 |
| 4,817,866 | A | 4/1989 | Wonnacott | |
| 4,890,440 | A | 1/1990 | Romagnoli | |
| 4,949,845 | A | 8/1990 | Dixon | |
| 4,974,771 | A | 12/1990 | Lavery | |
| 5,101,642 | A | 4/1992 | Alexandrov | |
| 5,137,211 | A | 8/1992 | Summer et al. | |
| 5,219,229 | A | 6/1993 | Sengewald | |
| 5,249,681 | A | 10/1993 | Miller | |
| 5,425,474 | A | 6/1995 | Dalea et al. | |
| 5,482,185 | A * | 1/1996 | McNaughton | |
| 5,505,372 | A | 4/1996 | Edson et al. | |
| 5,577,612 | A | 11/1996 | Chesson et al. | |
| 5,597,114 | A | 1/1997 | Kramedjian et al. | |
| 5,622,309 | A * | 4/1997 | Matsuda et al. | |
| 5,664,683 | A | 9/1997 | Brody | |
| 5,690,213 | A | 11/1997 | Matsumura | |
| 5,690,230 | A * | 11/1997 | Griffith | 229/122.1 |
| 5,794,778 | A | 8/1998 | Harris | |
| 5,826,783 | A | 10/1998 | Stout | |
| 5,875,961 | A | 3/1999 | Stone et al. | |
| 5,881,884 | A * | 3/1999 | Podosek | |
| 5,921,398 | A | 7/1999 | Carroll | |
| 5,924,559 | A | 7/1999 | Carrel et al. | |
| 5,927,498 | A | 7/1999 | Saam | |
| 6,050,402 | A | 4/2000 | Walter | |
| 6,176,419 | B1 | 1/2001 | Holley, Jr. | |
| 6,189,778 | B1 * | 2/2001 | Kanter | 229/122.1 |
| 6,283,293 | B1 * | 9/2001 | Lingamfelter | |
| 6,409,077 | B1 | 6/2002 | Telesca et al. | |
| D459,927 | S * | 7/2002 | Flowers et al. | |
| 6,478,219 | B1 | 11/2002 | Holley, Jr. | |
| 6,484,903 | B2 * | 11/2002 | Spivey et al. | |
| 6,550,615 | B2 * | 4/2003 | Lingamfelter | |
| 6,557,699 | B1 | 5/2003 | Focke et al. | |
| 6,578,736 | B2 * | 6/2003 | Spivey | |
| 6,604,677 | B1 | 8/2003 | Sutherland et al. | |
| 6,669,083 | B2 | 12/2003 | Bates | |
| 6,715,639 | B2 | 4/2004 | Spivey | |
| 6,752,262 | B1 | 6/2004 | Boriani et al. | |
| 6,789,673 | B2 | 9/2004 | Lingamfelter | |
| 6,866,186 | B2 * | 3/2005 | Fogle et al. | 229/242 |
| 6,902,104 | B2 | 6/2005 | Holley, Jr. et al. | |
| 6,918,487 | B2 | 7/2005 | Harrelson | |
| 6,929,172 | B2 | 8/2005 | Bates et al. | |
| 6,968,992 | B2 | 11/2005 | Schuster | |
| 6,969,172 | B2 | 11/2005 | Actis-Datta | |
| 6,974,072 | B2 | 12/2005 | Harrelson | |
| 6,991,107 | B2 | 1/2006 | Harrelson | |
| 6,997,316 | B2 | 2/2006 | Sutherland | |
| 7,000,803 | B2 | 2/2006 | Miller | |
| 7,073,665 | B2 | 7/2006 | Auclair et al. | |
| 7,104,435 | B2 | 9/2006 | Holley, Jr. | |
| 7,134,593 | B2 | 11/2006 | Harrelson | |
| 7,225,930 | B2 | 6/2007 | Ford et al. | |
| 7,240,789 | B2 * | 7/2007 | Sutherland | 206/427 |
| 7,337,942 | B2 | 3/2008 | Wang | |
| 7,604,157 | B2 * | 10/2009 | Zammit et al. | 229/240 |
| 2002/0029991 | A1 * | 3/2002 | Lingamfelter | |
| 2002/0070139 | A1 * | 6/2002 | Bates | |
| 2002/0088820 | A1 | 7/2002 | Spivey | |
| 2002/0088821 | A1 | 7/2002 | Spivey et al. | |
| 2002/0148887 | A1 * | 10/2002 | Auclair | 229/240 |
| 2002/0185499 | A1 * | 12/2002 | Harrelson et al. | |
| 2003/0141313 | A1 * | 7/2003 | Bates | |
| 2003/0150759 | A1 | 8/2003 | White, Jr. | |
| 2003/0192907 | A1 | 10/2003 | Bates | |
| 2004/0040334 | A1 | 3/2004 | Rusnock | |
| 2004/0060972 | A1 | 4/2004 | Harrelson | |
| 2004/0089575 | A1 | 5/2004 | Lingamfelter | |
| 2004/0089671 | A1 | 5/2004 | Miller | |
| 2004/0099558 | A1 | 5/2004 | Oliff et al. | |
| 2004/0155098 | A1 | 8/2004 | Harrelson | |
| 2004/0188277 | A1 | 9/2004 | Auclair | |
| 2004/0188300 | A1 | 9/2004 | Sutherland | |
| 2004/0188508 | A1 | 9/2004 | Holley, Jr. et al. | |
| 2005/0023170 | A1 | 2/2005 | Lingamfelter | |
| 2005/0092820 | A1 | 5/2005 | Chekroune | |
| 2005/0115843 | A1 | 6/2005 | Harrelson | |
| 2005/0126947 | A1 | 6/2005 | Holley, Jr. | |
| 2005/0167291 | A1 | 8/2005 | Sutherland | |
| 2005/0189405 | A1 | 9/2005 | Gomes et al. | |
| 2005/0224565 | A1 | 10/2005 | Holley, Jr. | |
| 2006/0054522 | A1 | 3/2006 | Kline et al. | |
| 2006/0091193 | A1 * | 5/2006 | DeBusk et al. | 229/122.1 |
| 2006/0118606 | A1 | 6/2006 | Holley, Jr. et al. | |
| 2006/0131370 | A1 | 6/2006 | Bates | |
| 2006/0175386 | A1 | 8/2006 | Holley, Jr. | |
| 2006/0255044 | A1 * | 11/2006 | Wilkins | 220/500 |
| 2007/0090175 | A1 * | 4/2007 | Schemmel | 229/242 |

FOREIGN PATENT DOCUMENTS

| | | | |
|---|---|---|---|
| EP | 0 066 029 | A1 | 12/1982 |
| FR | 2 549 010 | * | 1/1985 |
| GB | 2 264 101 | A * | 8/1993 |
| GB | 0202809 | | 2/2002 |
| WO | WO 96/29260 | * | 9/1996 |
| WO | WO 99/64301 | * | 12/1999 |
| WO | WO 00/03937 | * | 1/2000 |
| WO | WO 02/47990 | A2 * | 6/2002 |
| WO | WO 2004/043790 | A2 * | 5/2004 |
| WO | WO 2005/051781 | A1 | 6/2005 |
| WO | WO 2006/050210 | A2 | 5/2006 |
| WO | WO 2006/050316 | A1 | 5/2006 |

* cited by examiner

CARTON WITH DISPENSER

CROSS-REFERENCE TO RELATED APPLICATION

This application claims the benefit of U.S. Provisional Application No. 60/816,088 which was filed on Jun. 23, 2006. The entire content of the above-referenced provisional application is hereby incorporated by reference as if presented herein in its entirety.

BACKGROUND OF INVENTION

The present invention generally relates to cartons for holding and dispensing articles.

SUMMARY OF THE INVENTION

In general, one aspect of the invention is directed to a carton for containing a plurality of articles. The carton comprises a plurality of panels that extends at least partially around an interior of the carton. The plurality of panels comprises a top panel, a bottom panel, a first side panel, and a second side panel. A dispenser in the carton is for allowing removal of articles from the carton. The dispenser comprises a dispenser panel that is at least partially defined by a tear line in the carton and is for being at least partially removed for at least further opening a dispenser opening. In the top panel, the tear line comprises a first oblique portion extending from proximate an end of the dispenser panel to proximate a first edge of the top panel, a second oblique portion extending from proximate the end of the dispenser panel to proximate a second edge of the top panel, and a lateral portion extending between the first edge and the second edge.

In another aspect, the invention is generally directed to a blank for forming a carton. The blank comprises a plurality of panels. The plurality of panels comprises a top panel, a bottom panel, a first side panel, and a second side panel. The blank comprises dispenser features comprising at least one dispenser panel that is at least partially defined by a tear line for at least partially separating the dispenser panel from the blank. In the top panel, the tear line comprises a first oblique portion extending from the access flap to proximate a first edge of the top panel, a second oblique portion extending from the access flap to proximate a second edge of the top panel, and a lateral portion extending between the first edge and the second edge.

In another aspect, the invention is generally directed to a method of opening a carton. The method comprises providing a carton having a plurality of panels that extends at least partially around an interior of the carton. The plurality of panels comprises a top panel, a bottom panel, a first side panel, and a second side panel. The carton comprises a dispenser comprising a dispenser panel at least partially defined by a tear line in the carton and an access flap in the top panel. The tear line comprising a first oblique portion extending from the access flap to proximate a first edge of the top panel, a second oblique portion extending from the access flap to proximate a second edge of the top panel, and a lateral portion extending between the first edge and the second edge. The method further comprising pivoting the access flap to allow access to the dispenser panel and grasping the dispenser panel and at least partially separating the dispenser panel from the carton by at least partially tearing the carton along the first and second oblique portions and the lateral portion to create a dispenser opening in the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present invention generally relates to cartons housing a plurality of articles and a dispenser in the carton for removing articles from the carton. The present invention can be used, for example, in cartons that contain articles or other products such as, for example, food and beverages or pet food. The articles can also include soup cans or other food or beverage containers such as, for example, cans, bottles, PET containers, or other containers such as those used in packaging foodstuffs. For the purposes of illustration and not for the purpose of limiting the scope of the present invention, the following detailed description describes generally cylindrical containers as disposed within the carton embodiments. In this specification, the relative terms "lower," "bottom," "upper" and "top" indicate relative orientations determined in relation to fully erected cartons.

Figure 1:
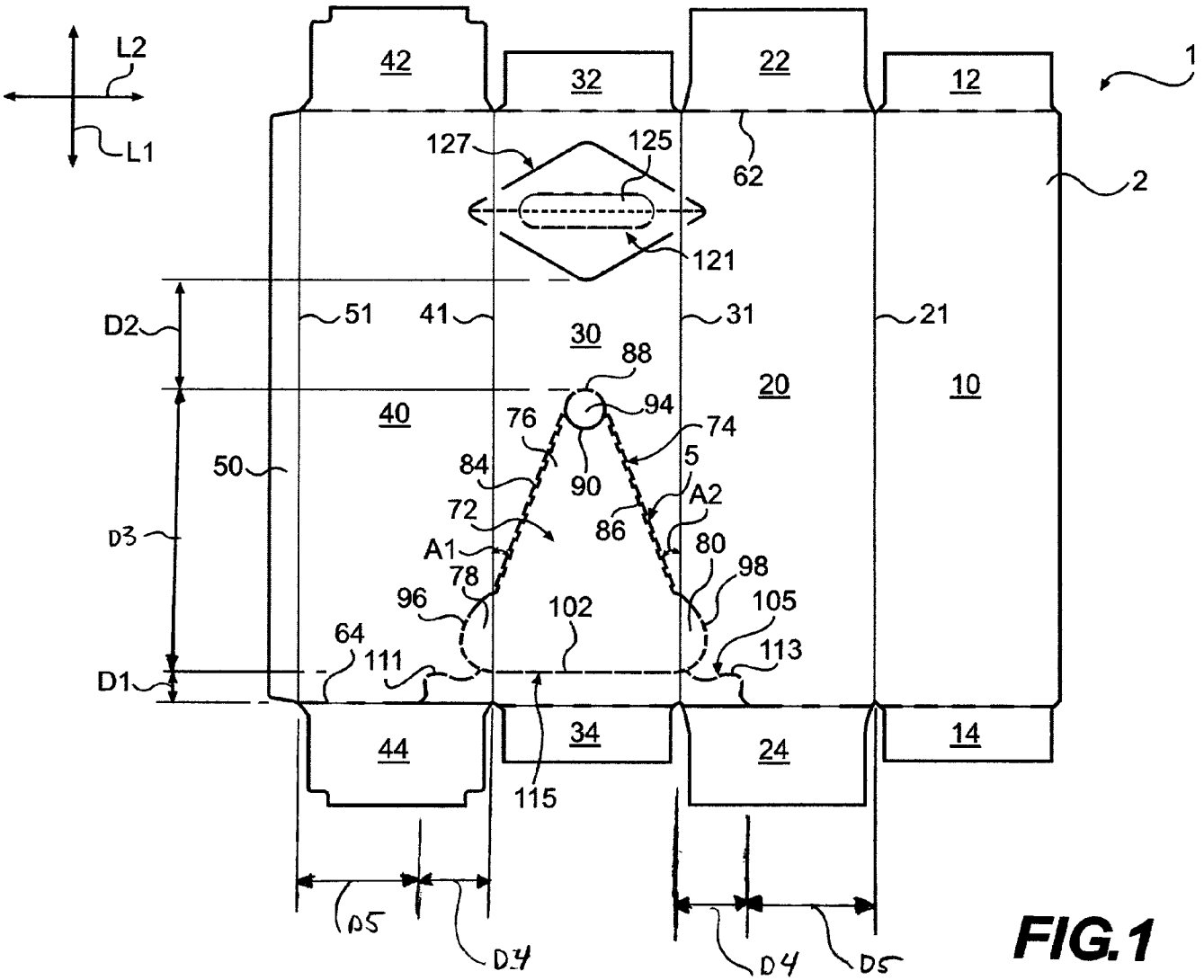
FIG. 1 is a plan view of a blank from which a carton according to an exemplary embodiment of this invention is formed.
Figure 2:
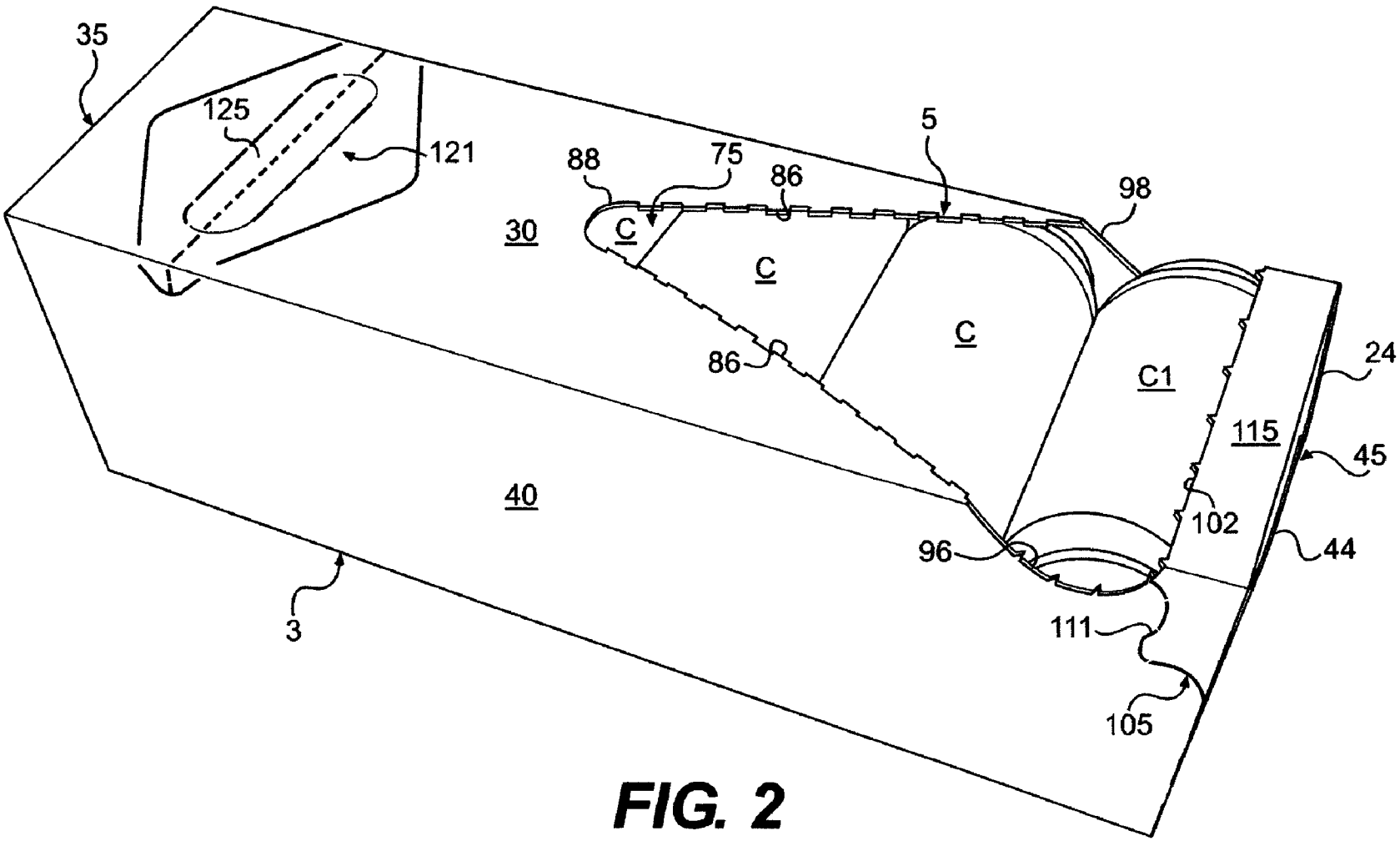
FIG. 2 is a perspective of the carton formed of the blank of FIG. 1 with containers in the carton and a dispenser panel removed.
Figure 3:
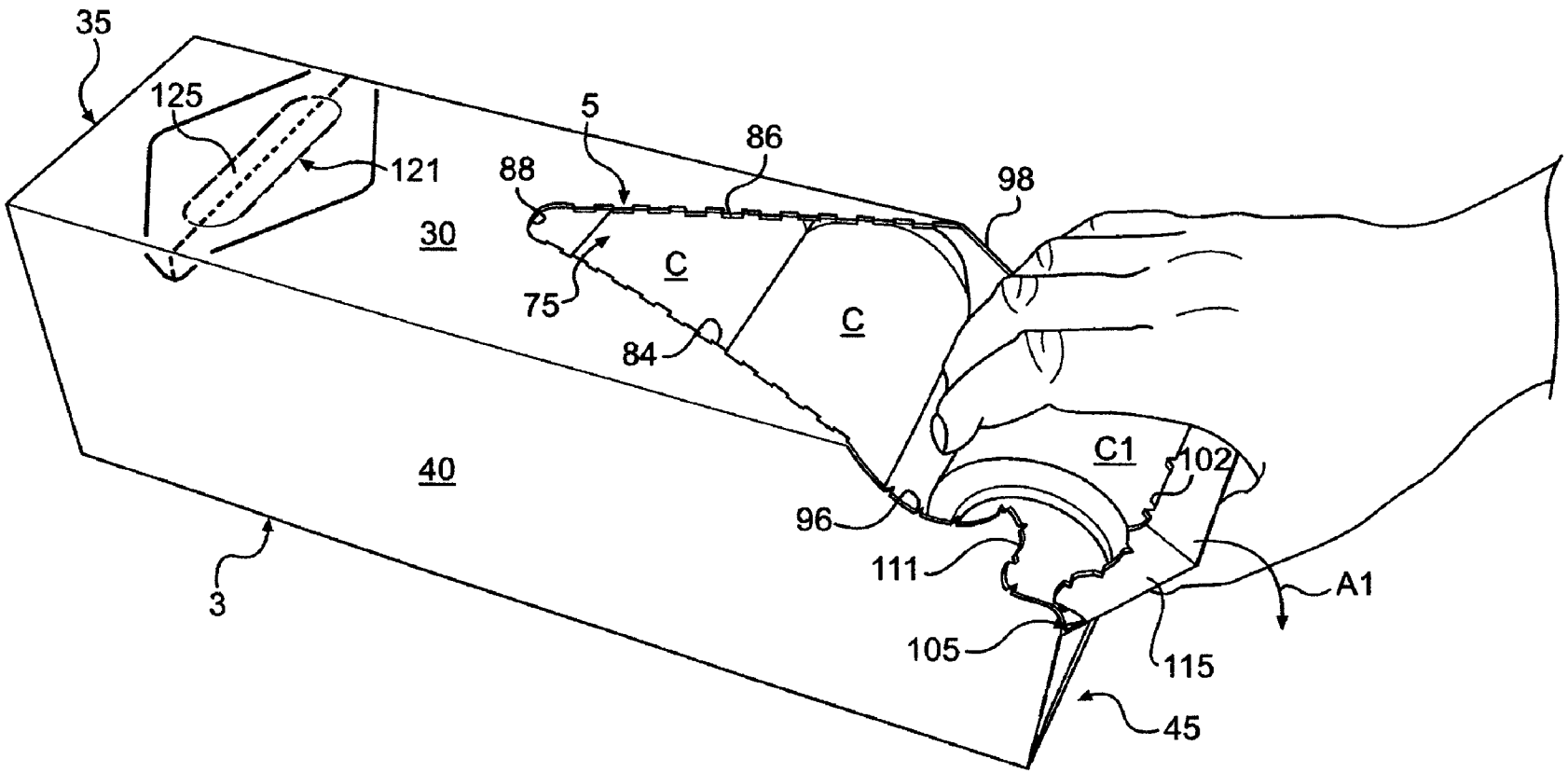
FIG. 3 is a perspective similar to FIG. 2 but showing a pivotable flap of the carton pivoted to allow removal of the containers.
Figure 4:
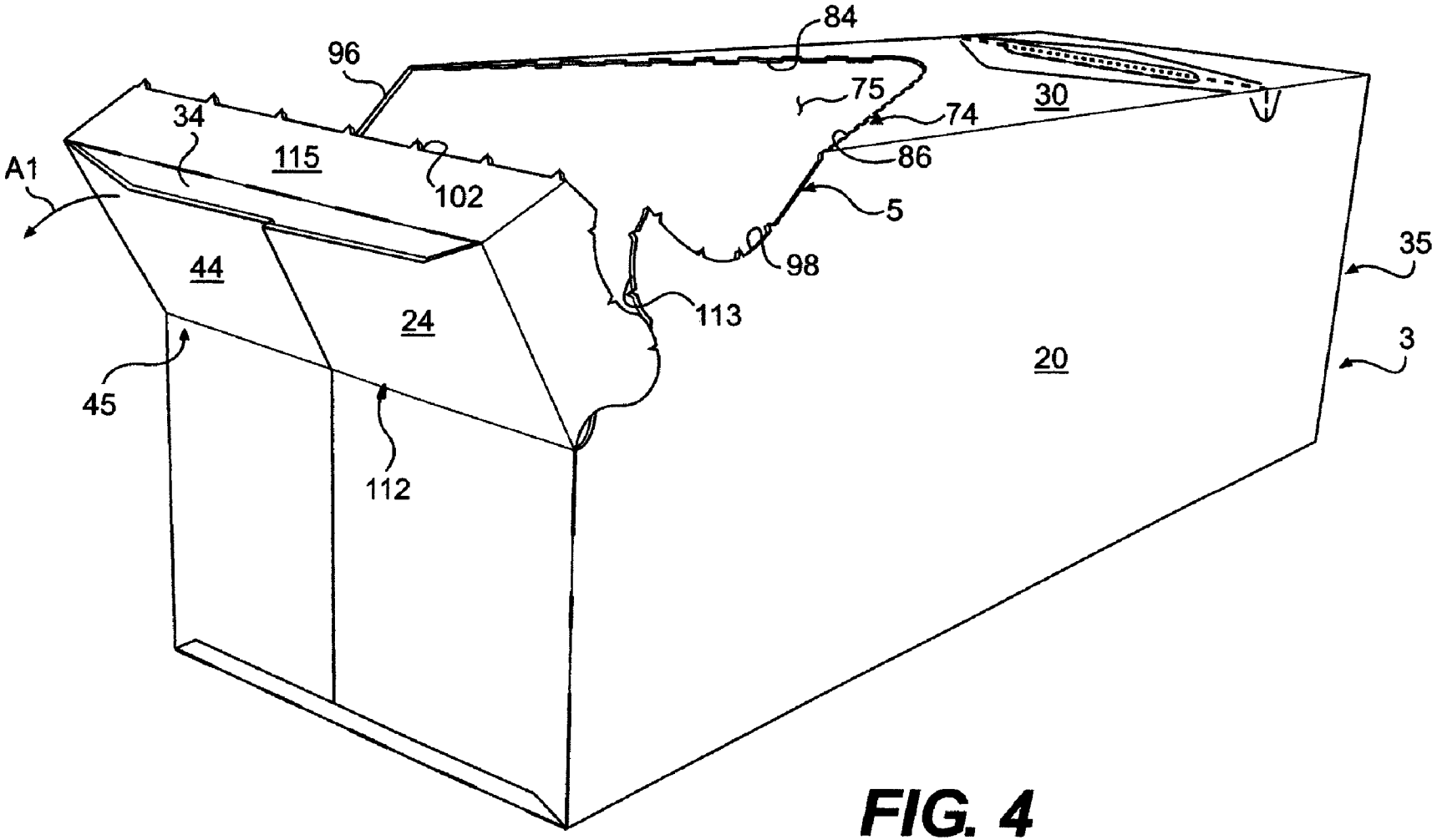
FIG. 4 is a perspective of the carton.

FIG. 1 is a plan view of the exterior side 2 of a blank, generally indicated at 1, used to form a carton 3 according to the exemplary embodiment of the invention. The carton 3 can be used to house a plurality of articles such as containers C (FIGS. 2 and 3). The carton 3 has various dispenser features, including a dispenser 5, formed in the carton for allowing access to the containers C. In the illustrated embodiment, the carton 3 is sized to hold twelve containers C arranged in a single layer in a 2×6 arrangement, but it is understood that the carton 3 may be sized and shaped to hold containers C of a different or same quantity in more than one layer and/or in different row/column arrangements (e.g., 1×12, 3×6, 2×6×2, 3×4×2, etc.)

The blank 1 has a longitudinal axis L1 and a lateral axis L2. In the illustrated embodiment, the blank 1 comprises a bottom panel 10 foldably connected to a first side panel 20 at a first longitudinal fold line 21, a top panel 30 foldably connected to the first side panel 20 at a second longitudinal fold line 31, and a second side panel 40 foldably connected to the top panel 30 at a third longitudinal fold line 41. An adhesive flap 50 is foldably connected to the bottom panel 10 at a fourth longitudinal fold line 51.

The bottom panel 10 is foldably connected to a first bottom end flap 12 and a second bottom end flap 14. The first side panel 20 is foldably connected to a first side end flap 22 and a second side end flap 24. The top panel 30 is foldably connected to a first top end flap 32 and a second top end flap 34. The second side panel 40 is foldably connected to a first side end flap 42 and a second side end flap 44. When the carton 3 is erected, the top and bottom end flaps 12 and 32 and side end flaps 22 and 42 close a first end 35 of the carton, and the top and bottom end flaps 14 and 34 and side end flaps 24 and 44 close a second end 45 of the carton. In accordance with an alternative embodiment of the present invention, different flap arrangements can be used for closing the ends 35, 45 of the carton.

The top and bottom end flaps 12 and 32 and side end flaps 22 and 42 extend along a first marginal area of the blank 1, and can be foldably connected at a first lateral fold line 62 that extends along the width of the blank. The top and bottom end flaps 14 and 34 and side end flaps 24 and 44 extend along a second marginal area of the blank 1, and can be foldably connected at a second lateral fold line 64 that also extends along the width of the blank. The lateral fold lines 62, 64 may be, for example, substantially straight, or offset at one or more locations to account for blank thickness or for other factors. The dispenser 5 includes a dispenser panel, generally indicated at 72, removably attached to the blank 1 at a tear line, generally indicated at 74. When the dispenser panel 72 is removed from the carton 3, a dispenser opening 75 (FIGS. 2 and 3) is exposed that allows the containers C to be selectively dispensed from the carton. In the illustrated embodiment, the dispenser panel 72 includes a first portion 76 in the top panel 30 of the blank 1, a second portion 78 in the side panel 40, a third portion 80 in the side panel 20. The tear line 74 includes a first portion 84 and a second portion 86 comprising respective oblique tear lines in the top panel 30 that converge and meet at a rounded portion 88 of the tear line. The dispenser 5 includes a curved fold line 90 radially opposed with the rounded corner 88 and cooperating with the rounded corner to form a generally round access flap 94 in the top panel 30 of the carton 3. In the illustrated embodiment, the access flap 94 is generally circular-shaped with the fold line 90 forming one circumferential portion of the flap (e.g., the bottom portion as viewed in FIG. 1) and the rounded portion 88 forming the other circumferential portion of the flap (e.g., the top portion as viewed in FIG. 1). Alternatively, the access flap 94 can take on a variety of different shapes (e.g., fold line 90 can be omitted and/or the rounded portion 88 can be shaped differently). The first portion 84 of the tear line 76 extends obliquely from the rounded portion 88 to the longitudinal fold line 41, and the second portion 86 extends obliquely from the rounded portion to the longitudinal fold line 31. As shown in FIG. 1, the first portion 84 of the tear line 76 is positioned at an oblique angle A1 relative to the longitudinal fold line 41, and the second portion 86 is positioned at an oblique angle A2 relative to the longitudinal fold line 31. In the illustrated embodiment, the angle A1 is approximately equal to the angle A2 so that the first portion 84 and second portion 86 of the tear line 74 respectively intersect the fold line 41, 31 at a location that is approximately the same longitudinal distance from the lateral fold line 64. It is understood that the magnitude of the angle A1 may vary from the magnitude of the angle A2 and that the angles may range from approximately zero to 90 degrees without departing from the scope of this invention. In the illustrated embodiment, the angles A1 and A2 are less than 90 degrees but the angles may vary from what is shown in the drawings without departing from the scope of this invention.

The tear line 74 includes a third portion 96 that connects to the first portion 84 at the longitudinal fold line 41. The third portion 96 is curved and extends down from the longitudinal fold line 41 into the side panel 40 and extends upward to return to the longitudinal fold line. A similarly shaped fourth portion 98 of the tear line 74 connects to the second portion 86 at the longitudinal fold line 31. The fourth portion 98 is curved and extends down from the tear line 31 into the side panel and extends upward to return to the longitudinal fold line. The tear line 74 includes a fifth portion 102 extending generally in the lateral direction in the top panel between the intersection of the third portion 96 with the longitudinal fold line 41 and the intersection of the fourth portion 98 with the longitudinal fold line 31. In the illustrated embodiment the lateral portion 102 of the tear line 74 in the top panel is spaced apart from the lateral fold line 64 by a distance D1, and the rounded portion 88 of the tear line is spaced apart from the lateral portion by a distance D3. Although, the tear line 74 may be otherwise configured without departing from the scope of this invention.

In the illustrated embodiment, the blank 1 includes various expansion features including a hinge, generally designated 105, that allows the dispenser opening 75 to be expanded to facilitate access to the container C in the carton 3. The hinge 105 includes a first curved tear line 111 in the blank 1 that extends from the third portion 96 of the tear line 74 of the dispenser 7 to the lateral fold line 64 and a second curved tear line 113 that extends from the fourth portion 98 of the tear line to the lateral fold line 64. The first and second curved tear lines 111, 113, respective portions of the third and fourth portions 96, 98 of the tear line 74, and the fifth portion 102 of the tear line of the dispenser 7 define a pivotable flap 115 of the carton 3. In the illustrated embodiment, the intersection of the each of the first and second curved tear lines 111, 113 with the lateral fold line 64 is spaced apart from a respective fold line 31, 41 a distance D4. The intersection of each of the first and second curved tear lines 111, 113 with the lateral fold line 64 is spaced apart from a respective fold line 21, 51 a distance D5. The pivotable flap 115 includes a portion of the first side panel 20, a portion of the top panel 30, a portion of the second side panel 40, and portions of the end flaps 24, 34, 44 forming the closed end 45 of the carton 3. The portion of the pivotable flap 115 in the top panel 30 provides a retention features to the carton that impedes removal of the containers C from the carton prior to pivoting the pivotable flap. As will be discussed in more detail below, the pivotable flap 115 is generally pivotable at the closed end of the carton 3 about a fold line 112 to expand the dispenser opening 75. The fold line 112 may be preformed in the end flaps 24, 44 of the blank 1 or the fold line can be formed during activation of the pivotable flap 115. The fold line 112 may be straight, curved, or otherwise shaped without departing from the scope of this invention. Further, the blank may include tear lines (not shown) in the side end flaps 24, 44 to facilitate removal of the pivotable flap 115 from the carton without departing from the scope of this invention. In the illustrated embodiment, the tear lines 111, 113 are curved but it is understood that the tear lines may be otherwise shaped (e.g., straight, oblique, L-shaped, etc.) without departing from the scope of this invention.

In the illustrated embodiment, the blank 1 includes a handle generally designated 121 in the top panel 30. The handle comprises an elongate handle flap 125 formed in the top panel 30 and a diamond-shaped crease 127 in the top panel and the first and second side panels 20, 40. The handle 121 may be activated by pressing on the handle flap 125 and folding the handle flap down to form an opening (not shown) in the carton 3 (e.g., the handle flap 125 is torn along a central tear line so that the resulting two handle flaps fold inwardly). The opening is shaped for insertion of a user's fingers during grasping of the carton 3. The handle 121 is spaced a longitudinal distance D2 in the top panel 30 away from the dispenser panel 72 at a location closer to the lateral fold line 62 of the blank than the lateral fold line 64. The location of the handle 121 of the illustrated embodiment allows user to grasp the carton 3 by placing their fingers through the handle flap 125 to form the opening in the top panel 30 and placing their thumb against the closed second end 35 of the carton. It is understood that the handle 121 may be otherwise shaped and located without departing from the scope of this invention.

As shown in FIG. 1, the distance D1 may be at least approximately 10% of the diameter of the containers C. In one embodiment, the distance D1 is at least approximately 0.8 inches (20 mm) and the diameter of the containers C may be at least approximately 2½ inches (63 mm). In the embodiment of FIG. 1, the distance D2 is at least approximately 3.8 inches (97 mm) and the distance D3 is at least approximately 7.4 inches (188 mm). As shown in FIG. 1, the distance D4 may be in the range of approximately 10% of the diameter of the containers C to approximately 200% of the diameter of the containers. The distance D5 may in the range of approximately 10% of the diameter of the containers C to approximately 200% of the diameter of the containers. In the embodiment of FIG. 1, the distance D4 is at least approximately 1.7 inches (43 mm) and the distance D5 is at least approximately 3.3 inches (84 mm). It is understood that the dimensional information provided herein is exemplary only, may be more or less than the dimensions listed herein, and is not intended to limit the scope of the invention.

In accordance with the exemplary embodiment, the blank 1 can be erected into the carton 3 by folding along fold lines 21, 31, 41, 51 and adhering the adhesive flap 50 to the bottom panel 10. The ends 35, 45 of the carton 3 can be closed by respectively overlapping and adhering the top and bottom end flaps 12, 32, 14, 34 and side end flaps 22, 42, 24, 44 after the containers C are inserted into the carton.

As shown in FIG. 3, the dispenser panel 72 may be removed from the carton 3 to form the dispenser opening 75. An exemplary opening process can begin with pressing against the access flap 94 to tear the dispenser panel 72 along the rounded portion 88 of the tear line 74 and fold the access flap 94 inward along fold line 90. Once the access flap 94 is folded inward, the dispenser panel 72 is grasped and pulled to tear the carton 3 along the first and second portions 84, 86, the third and fourth portions 96, 98, and the fifth portion 102 of the tear line 74 to separate the dispenser panel from the carton. As shown in FIG. 2, after separation and removal of the dispenser panel 72 the container C1 adjacent the closed end 45 of the carton 3 is restricted from being dispensed through the dispenser opening 75 by the portion of the top panel 30 forming the pivotable flap 115. Referring to FIG. 3, to remove the container C1, the container is grasped and pulled in the direction of arrow A1 to pivot the pivotable flap 115 about the fold line 112 to effectively increase the size of the dispenser opening 75 so that the end container may be removed from the carton 3. It is understood that the remaining containers C can be selectively removed from the carton 3 by removal through the dispenser opening 75. Alternatively, the pivotable flap 115 can be removed from the carton without departing from the scope of this invention.

The present invention can be used in cartons that include various features, including additional opening features that provide easy access to the articles, and tilt features that position the articles at the front or rear end of the carton.

The blank according to the present invention can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line or other line of disruption.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The foregoing description of the invention illustrates and describes various embodiments of the present invention. As various changes could be made in the above construction without departing from the scope of the invention, it is intended that all matter contained in the above description or shown in the accompanying drawings shall be interpreted as illustrative and not in a limiting sense. Furthermore, the scope of the present invention covers various modifications, combinations, alterations, etc., of the above-described embodiments that are within the scope of the claims. Additionally, the disclosure shows and describes only selected embodiments of the invention, but the invention is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the invention without departing from the scope of the invention.

What is claimed is:

1. A carton for containing a plurality of articles, the carton comprising:

a plurality of panels that extends at least partially around an interior of the carton, the plurality of panels comprises a top panel, a bottom panel, a first side panel, and a second side panel;

at least two end flaps respectively foldably attached to respective panels of the plurality of panels, wherein the end flaps are overlapped with respect to one another and thereby at least partially close an end of the carton, wherein the end flaps comprise a top end flap foldably attached to the top panel and side end flaps respectively foldably attached to the side end panels;

a dispenser for allowing removal of articles from the carton, the dispenser comprising a dispenser panel that is at least partially defined by a tear line in the carton and is for being at least partially removed for at least further opening a dispenser opening, the dispenser further comprising a hinge and a pivotable flap for enlarging the dispenser opening, the pivotable flap comprising at least a portion of the closed end, a portion of the first side panel, a portion of the second side panel, and at least a portion of the top end flap, in the top panel, the tear line comprising a first generally straight, oblique portion extending from an access feature at a first end of the dispenser panel to proximate a first edge of the top panel, a second generally straight, oblique portion extending from the access feature to proximate a second edge of the top panel, and a lateral portion extending between the first edge and the second edge at a second end of the dispenser panel, the second end of the dispenser panel being spaced apart from a third edge of the top panel.

2. The carton of claim 1 wherein the lateral portion extends substantially all the way to each of the first edge and the second edge.

3. The carton of claim 2 wherein the lateral portion intersects each of the first edge and the second edge.

4. The carton of claim 1 wherein the tear line further comprises a first curved portion in the first side panel.

5. The carton of claim 4 wherein the tear line further comprises a second curved portion in the second side panel.

6. The carton of claim 5 wherein the dispenser panel comprises at least a portion of the top panel, at least a portion of the first side panel, and at least a portion of the second side panel.

7. The carton of claim 1 wherein the tear line comprises a rounded portion at the first end of the dispenser panel and the first and second generally straight, oblique tear lines converge and meet at the rounded portion, the rounded portion defining at least a portion of the access feature.

8. The carton of claim 7 wherein the access feature comprises an access flap, and the dispenser panel comprises a fold line cooperating with the rounded portion of the tear line to form the access flap in the top panel for initiating removal of the dispenser panel.

9. The carton of claim 1 wherein the hinge comprises a curved tear line in each of the first side panel and the second side panel.

10. The carton of claim 1 wherein the pivotable flap comprises at least a portion of at least one of the side end flaps.

11. The carton of claim 1 wherein the first generally straight, oblique portion intersects the first edge at a first angle and the second generally straight, oblique portion intersects the second edge at a second angle.

12. The carton of claim 11 wherein the first angle is approximately equal to the second angle.

13. The carton of claim 1 wherein the dispenser panel is spaced apart from the closed end of the carton.

14. The carton of claim 13, wherein the lateral portion of the tear line is spaced from the closed end of the carton a first distance, the access feature is spaced apart from the closed end a second distance, and the second distance is larger than the first distance.

15. The carton of claim 13, further comprising a handle extending in at least the top panel, the dispenser panel being disposed between the handle and the closed end of the carton.

16. A blank for forming a carton comprising:

a plurality of panels, the plurality of panels comprises a top panel, a bottom panel, a first side panel, and a second side panel; and at least two end flaps respectively foldably attached to respective panels of the plurality of panels, wherein the end flaps comprise a top end flap foldably attached to the top panel and at least one side end flap respectively foldably attached to one of the side end panels;

dispenser features comprising at least one dispenser panel that is at least partially defined by a tear line for at least partially separating the dispenser panel from the blank and an access flap in the top panel for grasping the at least one dispenser panel;

expansion features comprising a hinge and a pivotable flap, the pivotable flap comprising at least a portion of the first side panel, and at least a portion of the second side panel, wherein the pivotable flap comprises at least a portion of the top end flap;

in the top panel, the tear line comprises a first generally straight, oblique portion extending from the access flap to proximate a first edge of the top panel, a second generally straight, oblique portion extending from the access flap to proximate a second edge of the top panel, and a lateral portion extending between the first edge and the second edge, the lateral portion being spaced apart from a third edge of the top panel.

17. The blank of claim 16 wherein the tear line further comprises a first curved portion in the first side panel and a second curved portion in the second side panel.

18. The blank of claim 17 wherein the dispenser panel comprises at least a portion of the top panel, at least a portion of the first side panel, and at least a portion of the second side panel.

19. The blank of claim 16 wherein the tear line comprises a rounded portion and the first and second generally straight, oblique tear lines converge and meet at the rounded portion.

20. The blank of claim 19 wherein the dispenser panel comprises a fold line cooperating with the rounded portion of the tear line to form the access flap in the top panel.

21. The blank of claim 16, wherein the hinge comprising comprises a curved tear line in each of the first side panel and the second side panel.

22. The blank of claim 16 wherein the first generally straight, oblique portion intersects the first edge at a first angle and the second generally straight, oblique portion intersects the second edge at a second angle, the first angle being approximately equal to the second angle.

23. The blank of claim 16, wherein the end flaps are for being overlapped with respect to one another for at least partially forming a closed end of the carton formed from the blank, and wherein the top end flap is foldably attached along at least a portion of the third edge of the top panel.

24. The blank of claim 23, wherein the lateral portion of the tear line is spaced from the third edge of the top panel a first distance, the access flap is spaced apart from the third edge a second distance, and the second distance is larger than the first distance.

25. The blank of claim 23, further comprising a handle extending in at least the top panel, the dispenser panel being disposed between the handle and the top end flap.

26. A method of opening a carton comprising:

providing a carton having a plurality of panels that extends at least partially around an interior of the carton, the plurality of panels comprises a top panel, a bottom panel, a first side panel, a second side panel, at least two end flaps respectively foldably attached to respective panels of the plurality of panels, wherein the at least two end flaps are overlapped with respect to one another and thereby at least partially form a closed end of the carton, the at least two end flaps comprising a top end flap foldably attached to the top panel and at least one side end flap respectively foldably attached to one of the first and second side panels, and a dispenser comprising a dispenser panel at least partially defined by a tear line in the carton and an access flap in the top panel, the tear line comprising a first generally straight, oblique portion extending from the access flap to proximate a first edge of the top panel, a second generally straight, oblique portion extending from the access flap to proximate a second edge of the top panel, and a lateral portion extending between the first edge and the second edge, the lateral portion being spaced apart from a third edge of the top panel;

pivoting the access flap to allow access to the dispenser panel; and grasping the dispenser panel and at least partially separating the dispenser panel from the carton by at least partially tearing the carton along the first and second oblique portions and the lateral portion to create a dispenser opening in the carton;

wherein the dispenser comprises a hinge and a pivotable flap for enlarging the dispenser opening, the pivotable flap comprising at least a portion of the closed end, a portion of the first side panel, a portion of the second side panel, and at least a portion of the top end flap.

27. The method of claim 26 further comprising removing a container from the carton through the dispenser opening.

28. The method of claim 26 further comprising expanding the dispenser opening by pivoting the pivotable flap to increase the size of the dispenser opening in the carton.

29. The method of claim 28 wherein the hinge is formed by a curved tear line in each of the first side panel and the second side panel, and wherein the pivoting of the pivotable flap comprises separating the pivotable flap along the curved tear lines.

30. The method of claim 29 wherein the pivoting of the pivotable flap comprises pivoting the pivotable flap about a fold line in the closed end of the carton.

* * * * *